US007344216B2

(12) United States Patent
Boesten

(10) Patent No.: US 7,344,216 B2
(45) Date of Patent: Mar. 18, 2008

(54) PRINT METHOD AND PRINTER SUITABLE FOR THE APPLICATION OF THE METHOD

(75) Inventor: Hubertus M. J. M. Boesten, Melick (NL)

(73) Assignee: Oce-Technologies B.V., Venlo (NL)

( * ) Notice: Subject to any disclaimer, the term of this patent is extended or adjusted under 35 U.S.C. 154(b) by 331 days.

(21) Appl. No.: 11/099,619

(22) Filed: Apr. 6, 2005

(65) Prior Publication Data

US 2005/0225580 A1 Oct. 13, 2005

(30) Foreign Application Priority Data

Apr. 7, 2004 (NL) ..... 1025895

(51) Int. Cl.
*B41J 29/38* (2006.01)

(52) U.S. Cl. ..... 347/9; 347/69; 347/14

(58) Field of Classification Search ..... 347/9–11, 347/16, 19, 69, 54, 40–42
See application file for complete search history.

(56) References Cited

U.S. PATENT DOCUMENTS 5,757,392 A * 5/1998 Zhang ..... 347/14
6,435,672 B1 * 8/2002 Groninger et al. ..... 347/69
6,926,388 B2 * 8/2005 Groninger et al. ..... 347/54
2004/0125158 A1 * 7/2004 Groninger et al. ..... 347/9

FOREIGN PATENT DOCUMENTS

EP 1 013 453 A2 6/2000
EP 1 378 359 A1 1/2004

* cited by examiner

*Primary Examiner*—Lam Son Nguyen
(74) *Attorney, Agent, or Firm*—Birch, Stewart Kolasch & Birch, LLP

(57) ABSTRACT

A printing method for forming an image on a substrate by means of a printer containing a plurality of ink-filled chambers, which chambers each include a nozzle and which are operatively connected to a piezoelectric actuator, which includes the steps of image-wise energizing of the actuators to generate a pressure wave in each of the chambers so that ink drops are ejected from the nozzles of said chambers, and measuring the pressure wave in a chamber using a piezoelectric actuator operatively connected to said chamber, wherein the image for formation is analyzed with the use of an importance criterion for elements of said image, the image elements satisfying said criterion are determined, the chambers from which the ink drops should be ejected to form said image elements are determined, and the pressure wave in at least one of said chambers is measured during the formation of the image. The invention also relates to a printer adapted to the use of this method.

6 Claims, 5 Drawing Sheets

PRINT METHOD AND PRINTER SUITABLE FOR THE APPLICATION OF THE METHOD

CROSS-REFERENCE TO RELATED APPLICATIONS

This nonprovisional application claims priority under 35 U.S.C. § 119(a) on Patent Application No. 1025895, filed in the Netherlands on Apr. 7, 2004, the entirety of which is incorporated herein by reference.

BACKGROUND OF THE INVENTION

The present invention relates to a printing method for forming an image on a substrate by means of a printer including a plurality of ink-filled chambers, each of which containing a nozzle operatively connected to a piezoelectric actuator, the method including the image-wise energization of the actuators to generate a pressure wave in each of the chambers so that ink drops are ejected from the nozzles of the chambers, and measuring the pressure wave in the chamber using a piezoelectric actuator operatively connected to said chamber. The present invention also relates to a printer adapted to this method.

A method of the above kind is known from European application EP 1 013 453. The inkjet printer of the piezo electric type known from this application has a printhead containing a number of ink chambers (also termed "ink duct" or, in short, "duct"), each chamber being operatively connected to a piezoelectric actuator. In one embodiment, an ink chamber has a flexible wall which is deformable by energization of the actuator connected to said wall. Deformation of the wall results in a pressure wave in the chamber and given sufficient strength this will result in the ejection of an ink drop from the nozzle of the chamber. The pressure wave in turn, however, results in deformation of the wall, and this may be transmitted to the piezoelectric actuator. Under the influence of its deformation the actuator will generate an electrical signal. This signal is directly dependent on the generated pressure wave in the chamber. Thus by measuring this signal the pressure wave in the associated chamber is measured indirectly.

From the said application it is known that analysis of this signal enables information to be obtained concerning the state of the ink chamber corresponding to said actuator. Thus it is possible to derive from this signal whether there is an air bubble or other irregularity in the chamber, whether the nozzle is clean, whether there are any mechanical defects in the ink chamber, and so on. In principle, any irregularity influencing the pressure wave itself can be traced by analysis of said signal. By using this known method, it is also possible in principle to measure each duct after each energization of the actuator. In this way, any irregularity which may have a negative effect on the print quality can be traced "on-the-fly" very accurately so that adequate action can be taken to obviate such a negative effect.

However, the known method has one significant disadvantage. Particularly when used in a printer with a large number of ink chambers, for example 100 or more ink chambers per printhead, the "on-the-fly" measurement of all the ink chambers results in a very high data rate of the signals for analysis. To enable these signals to be processed directly requires complex and hence expensive electronics.

SUMMARY OF THE INVENTION

The object of the present invention is to obviate this disadvantage. To this end, a method has been developed wherein the image for formation is analyzed with the use of an importance criterion for elements of said image, the image elements satisfying said criterion are determined, the chambers from which the ink drops should be ejected to form said image elements are determined, and the pressure wave in at least one of said chambers is measured during the formation of the image.

The present invention is based on the realization that some image elements are much more important in image formation than others. For example, in a CAD/CAM image, the information of single-pixel lines which, for example, represent contours of buildings or pipe work in a building, is much more important than a shadow part. In a final invoice sent by a supplier to a customer, the faultless reproduction of the total amount will be more important that the faultless indication of the goods supplied. In the formation of a three-dimensional image, image elements at the outer edge of the image are often more important than elements at the center of the image. In product data sheets perfect reproduction of the safety codes is often more important than perfect imaging of the safety icons. In the graphic industry, certain aesthetic details are often more important that a faultless filling of solid surfaces, and so on.

The present invention now comprises determining an importance criterion for the proposed elements of the image. In this way, using, for example, a central computer unit of the printer itself, it is possible to determine which elements of the image formation meet said criterion and which do not. For this purpose, the image information often fed in digital form to the printer can be used as an input to check the criterion. In this way a distinction can be made between image elements which are important in the image formation and which are less important. The present method proposes to determine the ink chambers from which the ink drops should be ejected for imaging the important image elements, in other words, which chambers should be actuated to eject ink drops in order to form the said parts of the image. Then it is precisely these chambers which belong to that group which are measured "on the fly" during printing. Depending on the importance criterion itself, often only a small part of the total number of chambers present will belong to the group of chambers from which the ink drops should be ejected to image the important image elements. Measuring these ink chambers at maximum results in a considerable reduction of the number of signals for analysis so that it is possible to carry out an effective quality control of the print process using relatively simple electronics. In a preferred embodiment, all the chambers corresponding to image elements which meet the criterion are measured.

In one embodiment of the method according to the present invention, the importance criterion is adapted to the image for formation. The importance criterion need not be an unchangeable criterion, for example stored in a memory, but can be adapted to the image for formation. In the imaging of photographs, the type of image elements that is important is quite different from those in the printing of text material. In the case of invoices, the elements that are important are quite different from those in a publicity folder. In this embodiment, the criterion is adapted to the image for formation. This can be effected, for example, by the printer user making known the type of image to a unit of the printer which then automatically determines the importance criterion, but it is also possible, for example, to determine, by automatic analysis of the image for formation, what type of image should be printed, whereafter automatic determination of the importance criterion is carried out. It is also possible that a user of the printer himself may input one or more importance criteria (for example: single pixel lines are important, numbers are important, and so on).

In one embodiment, wherein the printer comprises a printhead in which the ink chambers are disposed, in which method the image is formed on a flat substrate, the printhead being moved over the substrate in one or more print swaths, with part of the image being printed in each swath, the method is used separately for each sub-image. This embodiment is particularly suitable for printers in which the printhead or printheads are too small to form the image in one print step. Printheads often comprise a row of nozzles with a typical length of 1 to a few centimeters. With a row of this kind, it is possible to print a strip (often termed a "swath" or "print swath") of a substrate for printing in a width equal to the length of the row, by causing the printhead to carry out a scanning movement with respect to the substrate. In this way a sub-image forms on the substrate. By making a number of swaths of this head over the substrate, or, for example, arranging for a large number of heads, each to perform one swath over the substrate, the image can be built up from separate sub-images. Since the printing of a sub-image can be regarded as an independent action, it is advantageous to apply the method separately for each print swath. This gives more freedom in the use of the method and can thus be applied to obtain a better print result.

In one embodiment in which a maximum is set for the data rate accompanying the measurement of the pressure waves in the ink chambers, the frequency of measurement is so selected that the accompanying total data rate is equal at maximum to the maximum set for the data rate. In this embodiment, there is taken into account a maximum data rate suitable, for example, in the "on-the-fly" measurement of the state of ink chambers and the carrying out of adequate action. Let us assume, for example, that 30 ink chambers are identified which should eject the ink drops associated with important image elements, i.e. the image elements satisfying the importance criterion, during the formation of the image, but that at a maximum measuring frequency (i.e. an analysis of each ink chamber after each separate energization of the piezoelectric actuator corresponding thereto) the data rate is already at a maximum during the measurement of 18 ink chambers. In this case, in this embodiment it is decided to reduce the measuring frequency so that it is possible to measure "on-the-fly" all the ink chambers which correspond to the important image elements, but that the frequency of measurement is such that an analysis of these ink chambers takes place actually after one-half of all the energizations. The advantage of this embodiment is that all the important chambers are checked during printing.

In an alternative embodiment, the importance criterion is so determined that during the measurement, at a maximum frequency, of all the chambers corresponding to the image elements satisfying the criterion, the data rate associated therewith is at maximum equal to the said maximum. In this embodiment, in which a maximum data rate for the analysis of the state of the ink chambers is again taken into account, if the data rate is too high in the analysis of all the ink chambers corresponding to the image elements satisfying the importance criterion, the criterion itself is so adapted that the number of elements satisfying the adapted criterion is less, so that finally all the chambers corresponding to the image elements which satisfy the criterion can be measured at a maximum frequency. The advantage of this measurement is that the chambers for measurement can be very well controlled so that the risk of print artifacts as a result of irregularities in these chambers is practically zero.

The present invention also relates to a printer containing a number of ink-fillable chambers each provided with a nozzle and operatively connected to a piezoelectric actuator, wherein each of the actuators is connected to a measuring circuit to measure a pressure wave generated in the chamber by energization of an actuator, and using the actuator as a sensor, wherein the printer includes a processor adapted to determine those chambers from which ink drops should be ejected to form image elements satisfying an importance criterion. This enables the check on the chambers for irregularities during the actual use of the printer to be limited at maximum to those chambers which are required to print the important image elements.

The adaptation of the processor can consist of an integrated circuit specifically designed to carry out the said function (an ASIC). It is also possible to use a general processor loaded with computer codes (software) and thus able to carry out these functions. It should be noted that the processor need not form a physical part of a print engine itself, but it can be provided at a distance, for example in a computer unit such as a personal computer or server. This processor can accordingly be regarded as a printer component.

BRIEF DESCRIPTION OF THE DRAWINGS

The present invention will now be explained in detail with reference to the following drawings wherein:

FIG. 1 diagrammatically illustrates an inkjet printer. In this embodiment, the printer comprises a roller 10 to support a substrate (receiving medium) 12 and guide it along the four printheads 16. The roller 10 is rotatable about its axis as indicated by arrow A. A carriage 14 carries the four printheads 16, one for each of the colors: cyan, magenta, yellow and black, and can be moved in reciprocation in a direction indicated by the double arrow B parallel to the roller 10. In this way the printheads 16 can scan the receiving medium 12. The carriage 14 is guided on rods 18 and 20 and is driven by means suitable for the purpose (not shown).

Figure 1:
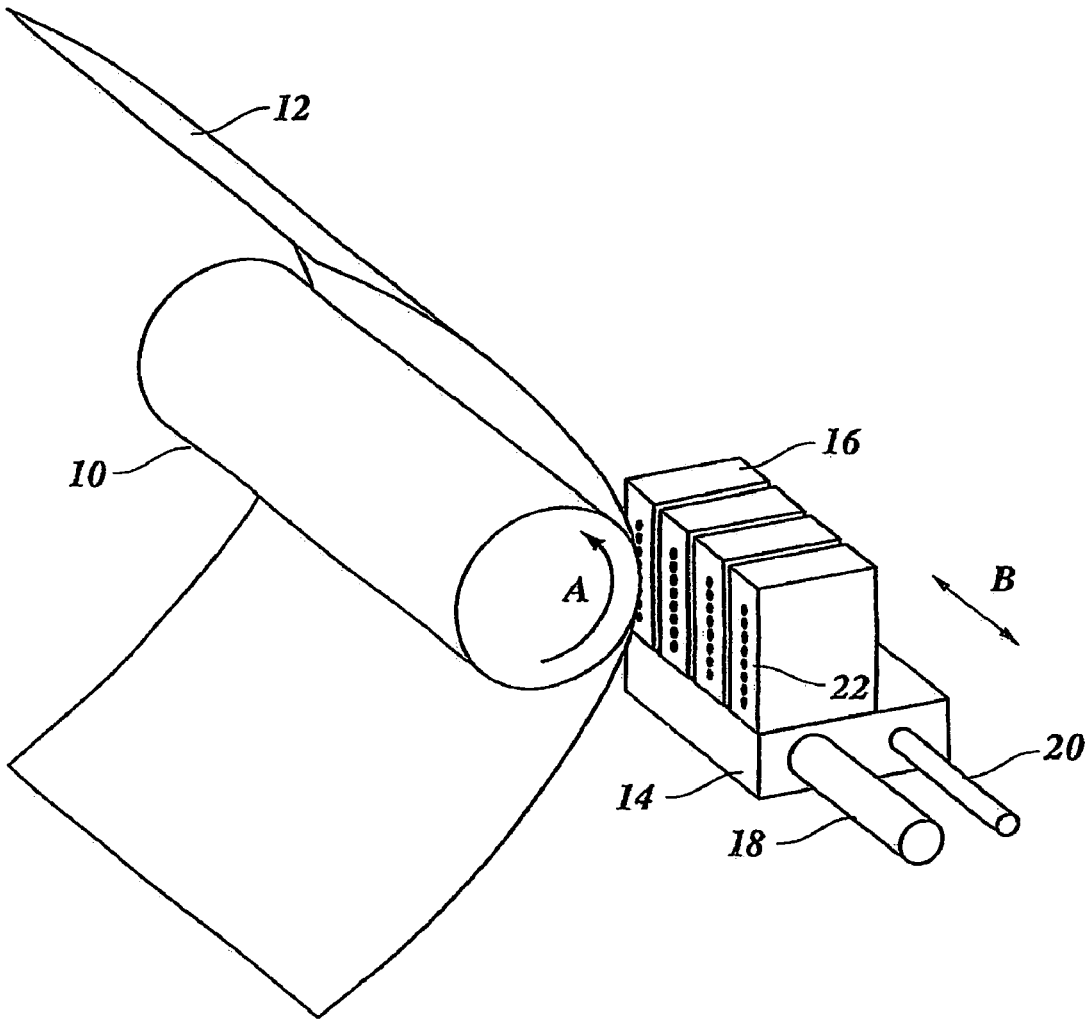
FIG. 1 is a diagram of an inkjet printer.

In the embodiment shown in the drawing, each printhead 16 comprises eight ink chambers, each with its own exit opening 22, which form an imaginary line perpendicular to the axis of the roller 10. In a practical embodiment of a printing device, the number of ink chambers per printhead 16 is many times greater. Each ink chamber is provided with a piezoelectric actuator (not shown) and associated actuation and measuring circuit (not shown) as described in connection with FIGS. 2 and 3. Each of the printheads also include a control unit for adapting the actuation pulses. In this way the ink chamber, actuator, actuation circuit, measuring circuit and control unit form a system serving to eject ink drops in the direction of the roller 10. Incidentally it is not essential for the control unit and/or for example all the elements of the actuation and measuring circuit to be incorporated physically in the actual printheads 16. It is also possible for these parts to be disposed, for example, in the carriage 14 or even in a more remote component of the printer, there being connections to components in the printheads 16 themselves. In this way, these parts nevertheless form a functional component of the printheads without actually being physically incorporated in the printheads. If the actuators are energized image-wise, an image which is built up as individual ink drops forms on the receiving medium 12.

Figure 2:
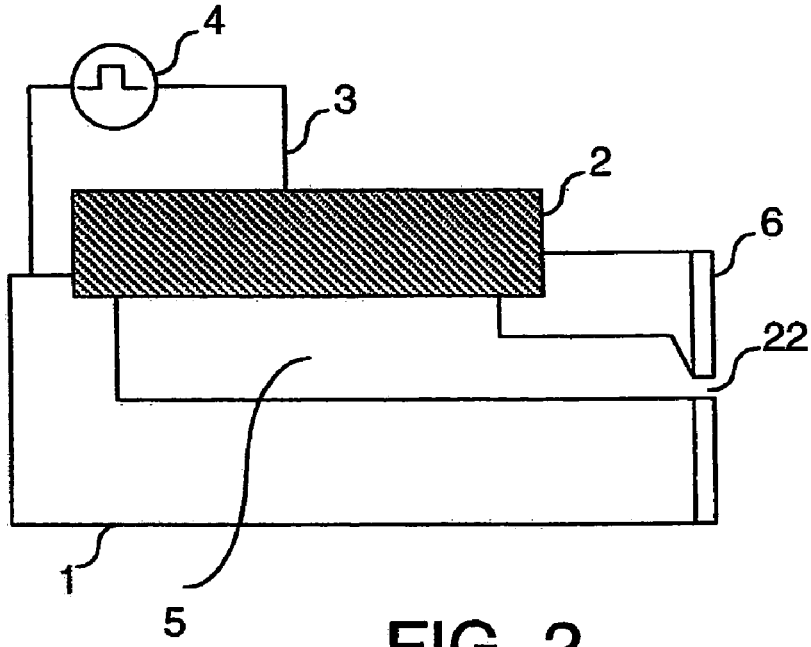
FIG. 2 is a diagram showing components of the inkjet printhead.

In FIG. 2, an ink chamber 5 is provided with an electromechanical actuator 2, in this example a piezoelectric actuator. Ink chamber 5 is formed by a groove in baseplate 1 and is defined at the top mainly by the piezoelectric actuator 2. At the end, ink chamber 5 merges into an exit opening 22 formed by a nozzle plate 6 in which a recess is made at the duct location. When a pulse is applied across actuator 2 by a pulse generator 4 via the actuation circuit 3, the actuator is deflected in the direction of the duct. As a result, the pressure in the duct is suddenly increased so that an ink drop is ejected from the exit opening 22. On completion of the drop ejection there is still a pressure wave present in the duct and this decays in the course of time. This wave in turn results in a deformation of the actuator 2 which then generates an electric signal. This signal is dependent on all the parameters which influence the formation of the pressure wave and damping thereof. In this way, information concerning these parameters can be obtained by measuring this signal. This information can in turn be used to control the print process.

Figure 3:
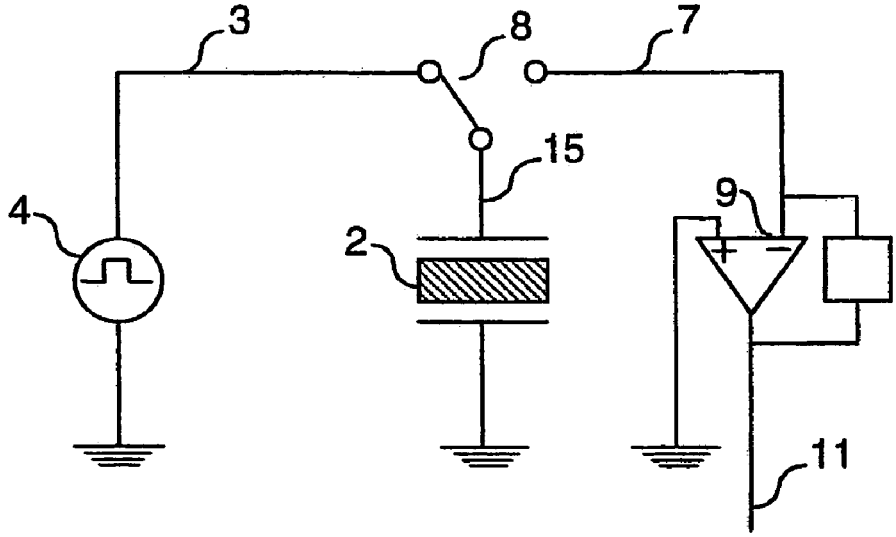
FIG. 3 is a schematic block diagram of the piezoelectric actuator, a drive circuit and a measuring circuit.

FIG. 3 is a block diagram of the piezoelectric actuator 2, the drive circuit 3 and the measuring circuit 7. The drive circuit 3, provided with the pulse generator 4, and the measuring circuit 7, provided with the amplifier 9, are connected to the piezoelement 2 via a common line 15. The circuits are broken and closed by tumbler switch 8. After a pulse has been applied across the piezoelement 2 by the pulse generator 4, said element in turn experiences a resulting vibration in the ink duct, which is converted into an electric signal by said element 2. If, after expiration of the pulse, the switch 8 is switched so that the measuring circuit is closed, the electrical signal is discharged across the measuring circuit 7. Amplifier 9 amplifies this signal which is fed via output 11 to an interpretation circuit (not shown), which may be followed by an action circuit (not shown). It is known from European patent application EP 1 013 453 how the circuits 3 and 7 should be switched. In addition, it is known from this patent application how the electric signal measured by the measuring circuit can be used to determine the state of the chamber.

Figure 4:
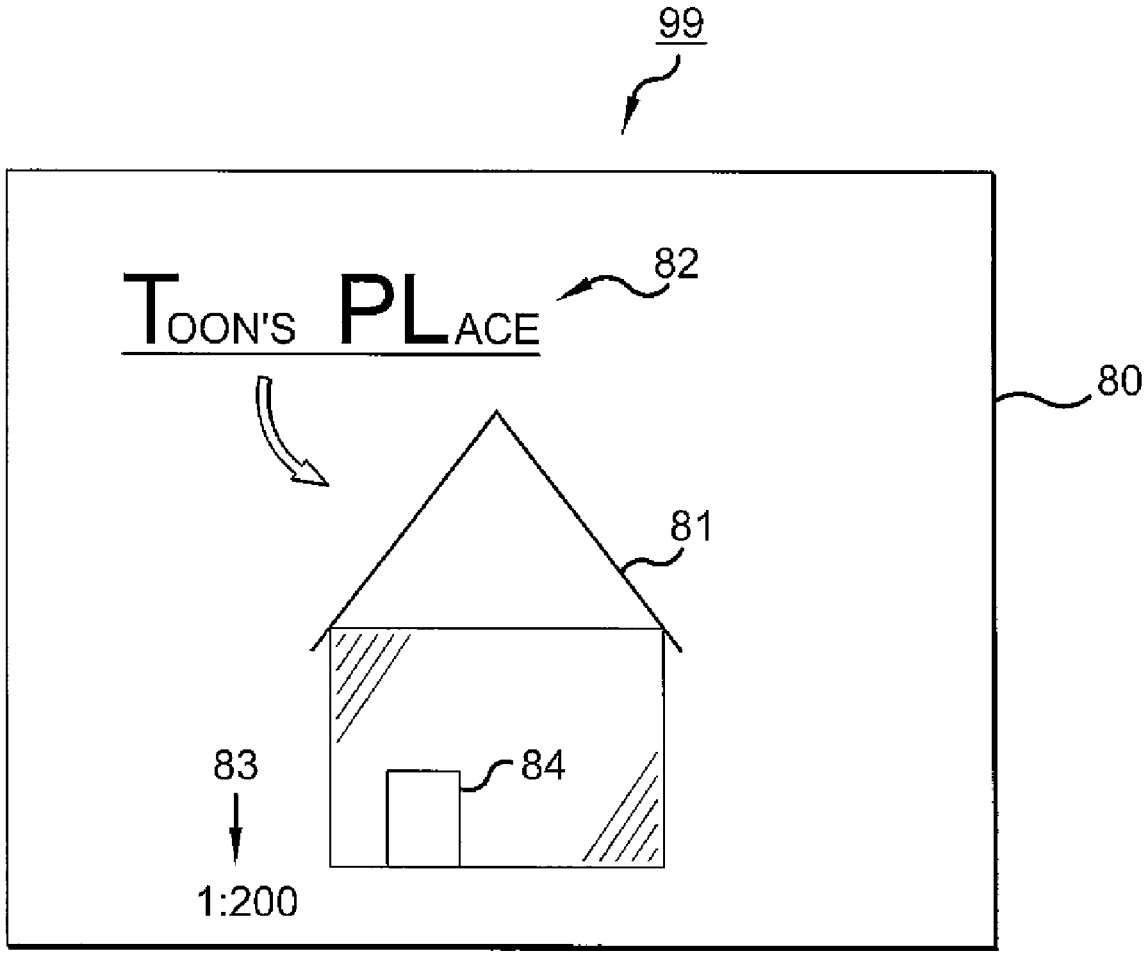
FIG. 4 is a diagram of an image 99 for formation.

FIG. 4 is a diagram of an image 99 for formation. This image consists of the frame edge 80 within which there is reproduced the front elevation 81 of a house and the name 82 of the house. In this case, the image is a building drawing from which a building contractor is to determine the measurements and shape of the front elevation of the house. For this purpose, the image also shows a scale 83 to which the drawing has been made.

It should be clear that for this image it is of a maximum importance that the contour lines of the house, and the door opening 84 in the facade, and the indication of the scale should be correctly reproduced when this drawing is printed out at a building site. This can prevent any incorrect interpretation of this drawing by the building contractor. Less important are the name of the house, the frame edge and the shadow parts indicated in the facade.

Figure 5:
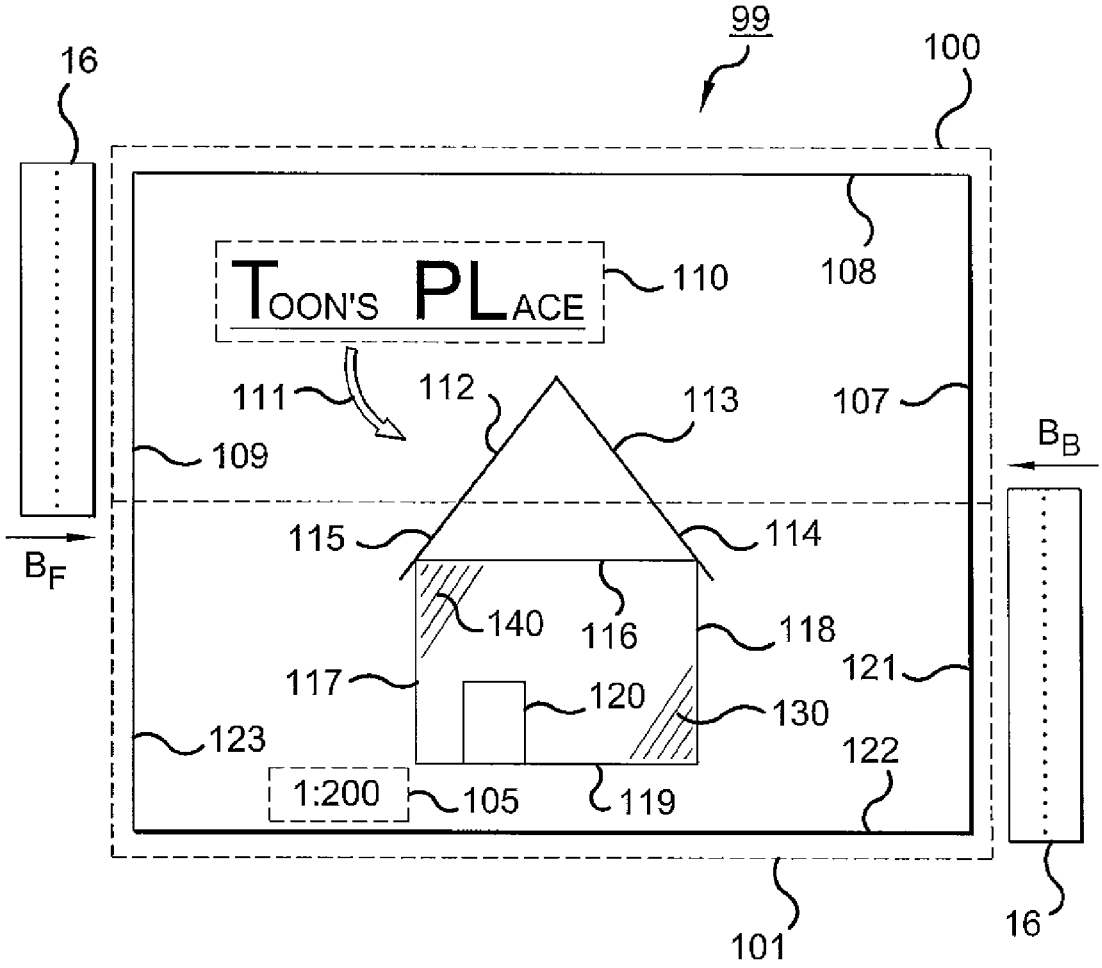
FIG. 5 shows the image of FIG. 4 but divided into two image halves.

FIG. 5 again shows the image 99 for formation, as indicated in FIG. 4. However, the image is now divided into two halves 100 and 101. In this example, each half corresponds to a strip equal to the width of the printhead 16. The top part 100 of the image can be formed in a first print swath, during which the printhead 16 is moved in a direction BF with respect to the substrate. The second sub-image 101 can be formed in another print swath in which the printhead 16 is moved in the direction BB with respect to the substrate. To enable the image 99 for formation to be analyzed, an importance criterion is determined for elements of the image. According to this criterion, image elements are important if they indicate the contour lines of buildings or elements of buildings or if they indicate the scale of the image for formation. In image half 100, image elements 112 and 113 which indicate parts of the contours of the roof of the house satisfy the importance criterion. Elements 107, 108 and 109 indicate the frame edge of the image for formation and do not therefore satisfy the criterion. Image element 110 with which the name of the house is indicated also does not meet the criterion, and the same applies to arrow 111. In image half 101, image elements 121, 122 and 123 (frame edge elements) do not satisfy the criterion. Image element 105 indicates the scale and therefore does satisfy the criterion. Image elements 114, 115, 116, 117, 118 and 119 indicate contour lines of the house and therefore do meet the criterion. Image element 120 indicates the door opening of the house and thus also meets the criterion. The hatching 130 and 140 does not meet the criterion.

Figure 6:
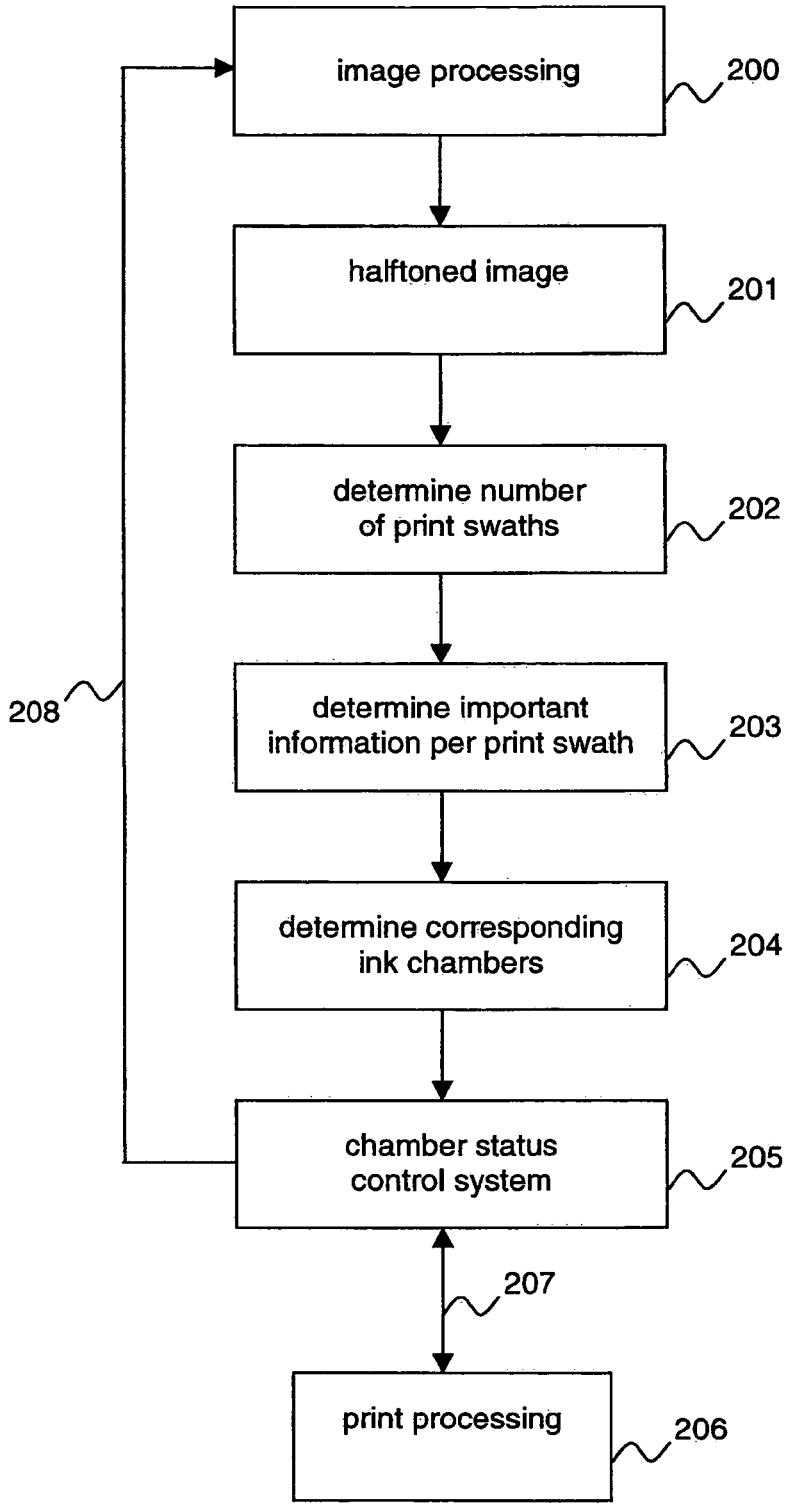
FIG. 6 is a diagram showing an example of how the invention can be applied.

FIG. 6 indicates a diagram of an example of how the invention can be applied. In step 200 the information forming the basis of an image for formation, for example an image in PostScript format, is processed and converted to a data format corresponding to that of the printer. In step 201 the information is converted to halftone information as is sufficiently known from the prior art. After this step, therefore, it is known from which discrete ink drops the image for formation should be built up.

In step 202 the number of print swaths required to completely form the image is determined. Also there is determined for each print swath what information of the halftone image corresponds to this print swath. In step 3, it is determined for each print swath what image elements of the information meet the importance criterion (in a way corresponding to the method as described in FIG. 5). Step 204 determines the chambers from which the ink drops should be ejected to form the important image elements. Determination of this kind is also sufficiently well known from the prior art. This information is passed to an ink chamber status control system. In step 205 this system ensures that the state of the latter chambers is measured, in a way as described in connection with FIGS. 2 and 3, during the actual formation of the image. To this end, information is exchanged with the print processor 206 via a connection 207 during printing. When the image has been formed, the image processing of a new image for formation takes place in step 200.

The above-described example assumes that the image consists of one color. It should however be clear that the method according to the present invention can also be applied if an image consists of more than one color. One possible way of applying the method according to the present invention is an application for each color sub-image separately. Alternatively, it is possible to analyze of itself the image which is to be finally formed. It should also be noted that the time at which the image for formation is analyzed does not form part of the present invention. This can take place just before the actual printing but also, for example, in a controller which processes images in a queue.

The invention being thus described, it will be obvious that the same may be varied in many ways. Such variations are not to be regarded as a departure from the spirit and scope for the invention, and all such modifications as would be obvious to one skilled in the art are intended to be included within the scope of the following claims.

What is claimed is:

1. A printing method for forming an image on a substrate by means of a printer containing a plurality of ink-filled chambers, which chambers each includes a nozzle and which are operatively connected to a piezoelectric actuator, which comprises:

image-wise energizing of the actuators to generate a pressure wave in each of the chambers so that ink drops are ejected from the nozzles of said chambers, and measuring the pressure wave in a chamber using a piezoelectric actuator operatively connected to said chamber, wherein, the image for formation is analyzed with the use of an importance criterion for elements of said image, the image elements satisfying said criterion are determined, the chambers from which the ink drops should be ejected to form said image elements are determined, and the pressure wave in at least one of said chambers is measured during the formation of the image.

2. The method of claim 1, wherein the importance criterion is adapted to the image for formation.

3. The method according to claim 1, wherein the printer comprises a printhead in which the ink chambers are disposed, in which method the printhead is moved over the substrate in one or more print swaths to form the image on a flat substrate, part of the image being printed in each swath, wherein the method is used separately for each sub-image.

4. The method according to claim 1, wherein a maximum is set for the data rate associated with the measurement of the pressure waves in the chamber, and wherein the frequency at which measurements are carried out is so selected that the total data rate associated therewith is at a maximum equal to the said maximum.

5. The method according to claim 1, wherein a maximum is set for the data rate associated with the measurement of the pressure waves in the chambers, and wherein the importance criterion is so determined that during the measurement, at a maximum frequency, of all the chambers corresponding to the image elements satisfying the criterion, the data rate associated therewith is at maximum equal to the said maximum.

6. A printer comprising a number of ink-fillable chambers, each provided with a nozzle and operatively connected to a piezoelectric actuator, wherein each of the actuators is connected to a measuring circuit to measure a pressure wave generated in the chamber by the energization of the actuator, using the actuator as a sensor, and wherein the printer includes a processor adapted to analyze an image for formation with the use of an importance criterion for elements of said image, to determine the image elements satisfying said criterion, to determine the chambers from which the ink drops should be ejected to form said image elements, and to measure the pressure wave in at least one of said chambers during the formation of the image.

* * * * *